US012680449B2

(12) United States Patent
Keilers et al.

(10) Patent No.: US 12,680,449 B2
(45) **Date of Patent: *Jul. 14, 2026**

(54) WIRELESSLY-CONFIGURABLE BOTTOM HOLE ASSEMBLIES

(71) Applicant: Schlumberger Technology Corporation, Sugar Land, TX (US)

(72) Inventors: Adam Keilers, Richmond, TX (US); Mohammad Hajjari, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/233,276

(22) Filed: Jun. 10, 2025

(65) Prior Publication Data

US 2025/0297546 A1 Sep. 25, 2025

Related U.S. Application Data

(63) Continuation of application No. 18/354,299, filed on Jul. 18, 2023, now Pat. No. 12,331,637.

(51) Int. Cl.
*E21B 47/13* (2012.01)

(52) U.S. Cl.
CPC ..... *E21B 47/13* (2020.05)

(58) Field of Classification Search
CPC ..... E21B 47/13; E21B 47/12
See application file for complete search history.

(56) References Cited

U.S. PATENT DOCUMENTS

| | | | | |
|---|---|---|---|---|
| 2008/0007421 | A1* | 1/2008 | Liu | G01V 11/002 340/853.3 |
| 2015/0077265 | A1* | 3/2015 | Gao | E21B 47/16 340/853.7 |
| 2017/0022805 | A1* | 1/2017 | van Zelm | E21B 17/20 |
| 2017/0122815 | A1* | 5/2017 | Choi | H03L 1/00 |
| 2018/0371901 | A1* | 12/2018 | Lakings | E21B 7/06 |
| 2020/0378245 | A1* | 12/2020 | Miller | E21B 47/12 |
| 2021/0372243 | A1* | 12/2021 | Arukhe | F03G 7/122 |
| 2023/0296013 | A1* | 9/2023 | Lanning | E21B 44/04 |

* cited by examiner

*Primary Examiner* — Amine Benlagsir
(74) *Attorney, Agent, or Firm* — Jeffrey D. Frantz

(57) ABSTRACT

Systems and methods presented herein facilitate coiled tubing operations, and generally relate to wirelessly configuring bottom hole assemblies (BHAs) for use in coiled tubing well operations. For example, certain embodiments of the present disclosure include a method that includes wirelessly communicatively coupling at least one user computing device to a wireless access point of a wireless access module of a BHA. The method also includes wirelessly receiving one or more command signals from the at least one user computing device via the wireless access point of the wireless access module of the BHA. The method further includes adjusting one more operating settings or procedures of one or more downhole tool components of the BHA based at least in part on the one or more command signals.

19 Claims, 6 Drawing Sheets

WIRELESSLY-CONFIGURABLE BOTTOM HOLE ASSEMBLIES

CROSS-REFERENCE TO RELATED APPLICATIONS

This patent application is a continuation of co-pending U.S. patent application Ser. No. 18/354,299, filed Jul. 18, 2023, which is herein incorporated by reference.

BACKGROUND

The present disclosure generally relates to systems and methods for wirelessly configuring bottom hole assemblies for use in coiled tubing well operations.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

To facilitate oil and gas well operations, a well string may include a bottom hole assembly ("BHA"), which may include a drill bit, one or more downhole well tools (e.g., which may include various sensors, sampling tools, and so forth). Such BHAs are often configured for particular types of downhole well operations. However, it may be advantageous to configure such BHAs for specific expected downhole well conditions. Unfortunately, configuring BHAs for specific expected downhole well conditions may be relatively difficult insofar as BHAs can be relatively large and, sometimes, may be suspended in locations that are not easily reachable by engineers.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include systems and methods for wirelessly configuring bottom hole assemblies (BHAs) for use in coiled tubing well operations. For example, certain embodiments of the present disclosure include a method that includes wirelessly communicatively coupling at least one user computing device to a wireless access point of a wireless access module of a BHA configured to be utilized to perform one or more coiled tubing well operations. The method also includes wirelessly receiving one or more command signals from the at least one user computing device via the wireless access point of the wireless access module of the BHA. The method further includes adjusting one or more operating settings or procedures of one or more downhole tool components of the BHA based at least in part on the one or more command signals.

In addition, certain embodiments of the present disclosure include a BHA having one or more downhole tool components configured to be used by the BHA to perform one or more coiled tubing well operations. The BHA also includes a wireless access module that includes a wireless access point configured to wirelessly communicatively couple to at least one user computing device external to the BHA. The wireless access module also includes one or more memory media configured to store instructions for operating the wireless access module and data collected from the one or more downhole tool components during performance of the one or more coiled tubing well operations. The wireless access module further includes one or more processors configured to execute the instructions stored in the one or more memory media.

In addition, certain embodiments of the present disclosure include a wireless access module configured to be installed within a BHA configured to be utilized to perform one or more coiled tubing well operations. The wireless access module includes a wireless access point configured to wirelessly communicatively couple to at least one user computing device external to the BHA. The wireless access module also includes one or more memory media configured to store instructions for operating the wireless access module and data collected from one or more downhole tool components of the BHA during performance of the one or more coiled tubing well operations. The wireless access module further includes one or more processors configured to execute the instructions stored in the one or more memory media.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
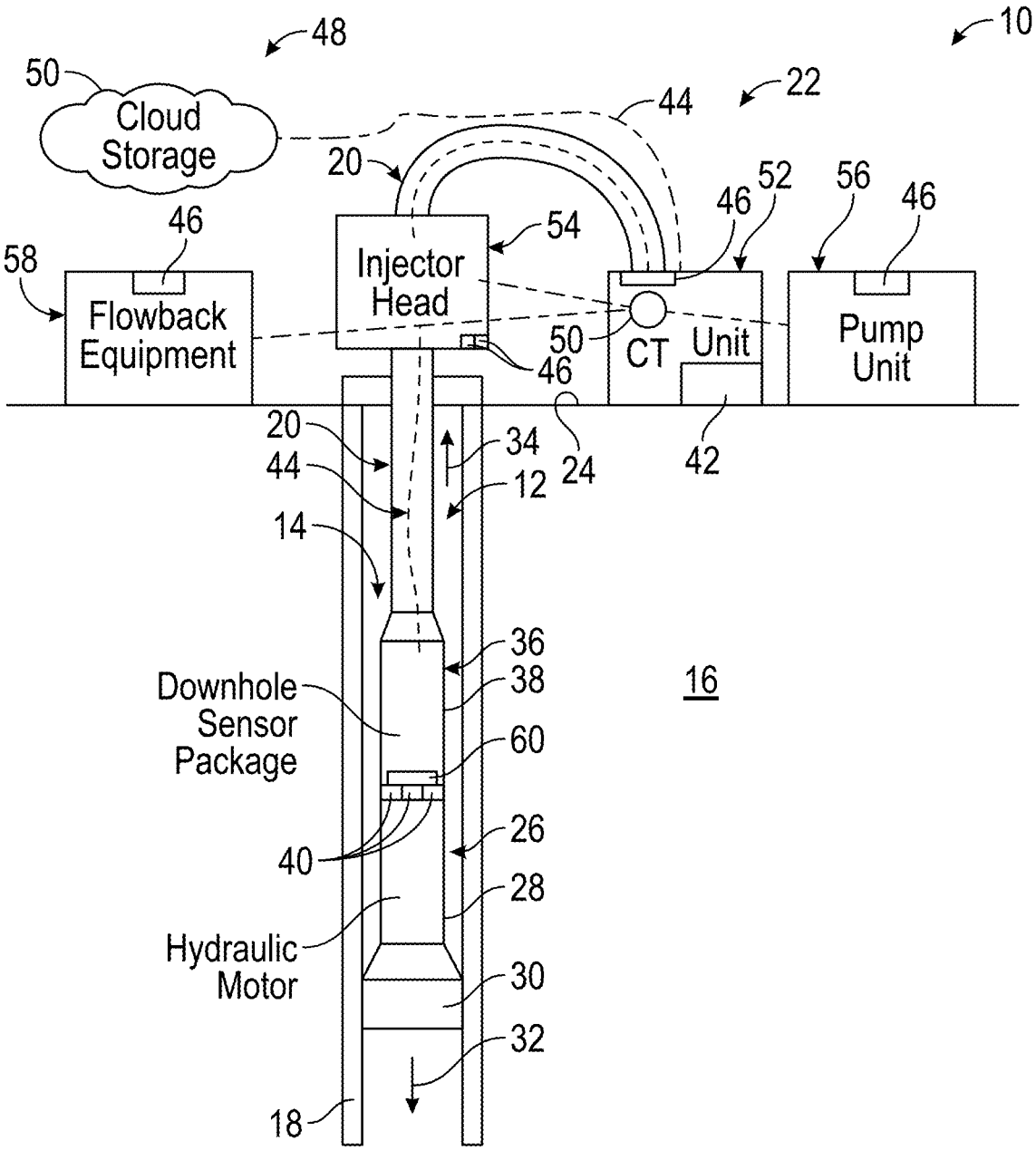
FIG. 1 illustrates a schematic diagram of an example oil and gas well system having a wirelessly-configurable battery-powered bottom hole assembly (BHA), in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed or are caused to be performed, for example, by a processing system (i.e., solely by the processing system, without human intervention). In addition, as used herein, the term "approximately equal to" may be used to mean values that are relatively close to each other (e.g., within 5%, within 2%, within 1%, within 0.5%, or even closer, of each other).

The embodiments described herein enable a battery powered coiled tubing bottom hole assembly (BHA) to be wirelessly configured and/or to download data at a field location. For example, as described in greater detail herein, the BHA may be equipped with a wireless access point that facilitates remote communication with the BHA. This enables field users to communicate with a downhole well tool of the BHA without physically connecting a data cable to the BHA, thereby eliminating health, safety, and environment (HSE) risks if the BHA is disposed at locations (e.g., stored at a height) of the field location that are not easily accessible by the field users between downhole runs. In certain embodiments, if the wireless access point of the BHA is routed to a cloud gateway, this would enable remote access and configuration of downhole well tools of the BHA, which would be a novel capability for a battery powered coiled tubing BHA.

With the foregoing in mind, FIG. 1 illustrates a schematic diagram of an example oil and gas well system 10. As illustrated, in certain embodiments, a coiled tubing string 12 may be run into a wellbore 14 that traverses a hydrocarbon-bearing formation 16 (i.e., reservoir). While certain elements of the oil and gas well system 10 are illustrated in FIG. 1, other elements of the oil and gas well system 10 (e.g., blow-out preventers, wellhead "tree", etc.) may be omitted for clarity of illustration. In certain embodiments, the oil and gas well system 10 includes an interconnection of pipes, including vertical and/or horizontal casings 18, coiled tubing 20, and so forth, that connect to a surface facility 22 at the surface 24 of the oil and gas well system 10. In certain embodiments, the coiled tubing 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the coiled tubing 20. As illustrated in FIG. 1, in certain embodiments, the BHA 26 may include a downhole motor 28 that operates to rotate a drill bit 30 (e.g., during drilling operations) or other downhole tools. In certain embodiments, the downhole motor 28 may be driven by hydraulic forces carried in fluid supplied from the surface 24 of the oil and gas well system 10. In certain embodiments, the BHA 26 may be connected to the coiled tubing 20, which is used to run the BHA 26 to a desired location within the wellbore 14. It is also contemplated that, in certain embodiments, the rotary motion of the drill bit 30 may be driven by rotation of the coiled tubing 20 effectuated by a rotary table or other surface-located rotary actuator. In such embodiments, the downhole motor 28 may be omitted. As described in greater detail herein, the BHA 26 may be wirelessly configured prior to being deployed within the wellbore 14.

In certain embodiments, the coiled tubing 20 may also be used to deliver fluid 32 to the drill bit 30 through an interior of the coiled tubing 20 to aid in the drilling process and carry cuttings and possibly other fluid or solid components in return fluid 34 that flows up the annulus between the coiled tubing 20 and the casing 18 (or via a return flow path provided by the coiled tubing 20, in certain embodiments) for return to the surface facility 22. It is also contemplated that the return fluid 34 may include remnant proppant (e.g., sand) or possibly rock fragments that result from a hydraulic fracturing application, and flow within the oil and gas well system 10. Under certain conditions, fracturing fluid and possibly hydrocarbons (oil and/or gas), proppants and possibly rock fragments may flow from the fractured formation 16 through perforations in a newly opened interval and back to the surface 24 of the oil and gas well system 10 as part of the return fluid 34. In certain embodiments, the BHA 26 may be supplemented behind a rotary drill by an isolation device such as, for example, an inflatable packer that may be activated to isolate the zone below or above it and enable local pressure tests.

As such, in certain embodiments, the BHA 26 may include a downhole well tool 36 that is moved along the wellbore 14 via the coiled tubing 20. In certain embodiments, the downhole well tool 36 may include a variety of drilling/cutting tools coupled with the coiled tubing 20 to provide a coiled tubing string 12. In the illustrated embodiment, the downhole well tool 36 includes the drill bit 30, which may be powered by the downhole motor 28 (e.g., a positive displacement motor (PDM), or other hydraulic motor) of the BHA 26. In certain embodiments, the wellbore 14 may be an open wellbore or a cased wellbore defined by the casing 18. In addition, in certain embodiments, the wellbore 14 may be vertical or horizontal or inclined. It should be noted that the downhole well tool 36 may be part of various types of BHAs 26 coupled to the coiled tubing 20.

As also illustrated in FIG. 1, in certain embodiments, the BHA 26 may include a downhole sensor package 38 having multiple downhole sensors 40. In certain embodiments, the sensor package 38 may be mounted along the coiled tubing string 12, although certain downhole sensors 40 may be positioned at other downhole locations in other embodiments. In addition, in certain embodiments, downhole sensors 40 disposed on the BHA 26 may be configured to detect downhole flow rates, downhole temperatures, and downhole pressures, and so forth, in the wellbore 14.

In certain embodiments, data from the downhole sensors 40 may be relayed uphole to a surface processing system 42 (e.g., a computer-based processing system) disposed at the surface 24 and/or other suitable location of the oil and gas well system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

In addition, as described in greater detail herein, the BHA 26 may include a wireless access point 60 that enables field users to communicate with components of the BHA 26 (e.g., the downhole well tool 36, the downhole sensor package 38, the downhole hydraulic motor 28, and so forth) for the purpose of configuring these components between downhole runs of the BHA 26 into various wellbores 14.

As illustrated, in certain embodiments, the coiled tubing 20 may be deployed by a coiled tubing unit 52 and delivered downhole via an injector head 54. In certain embodiments, the injector head 54 may be controlled to slack off or pick up the coiled tubing 20 so as to control the tubing string weight and, thus, the weight on bit (WOB) acting on the drill bit 30 (or the downhole well tool 36). In certain embodiments, the downhole well tool 36 may be moved along the wellbore 14 via the coiled tubing 20 under control of the injector head 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, the data may be used to fully or partially automate downhole operations, to optimize the downhole operations, and/or to provide more accurate predictions regarding components or aspects of the downhole operations.

In certain embodiments, fluid 32 may be delivered downhole under pressure from a pump unit 56. In certain embodiments, the fluid 32 may be delivered by the pump unit 56 through the downhole hydraulic motor 28 to power the downhole hydraulic motor 28 and, thus, the drill bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including well treatment applications.

As described in greater detail herein, the coiled tubing unit 52, the injector head 54, the pump unit 56, and the flowback equipment 58 may include advanced surface sensors 46, actuators, and local controllers, such as PLCs, which may cooperate together to provide sensor data to, receive control signals from, and generate local control signals based on communications with, respectively, the surface processing system 42. In certain embodiments, as described in greater detail herein, the surface sensors 46 may include flow rate, pressure, and fluid rheology sensors 46, among other types of sensors. In addition, as described in greater detail herein, the actuators may include actuators for pump and choke control of the pump unit 56 and the flowback equipment 58, respectively, among other types of actuators.

In certain embodiments, surface sensors 46 of the coiled tubing unit 52 may be configured to detect positions of the coiled tubing 20, weights of the coiled tubing 20, and so forth. In addition, in certain embodiments, surface sensors 46 of the injector head 54 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluids production rates, solids production rates, and so forth.

Figure 2:
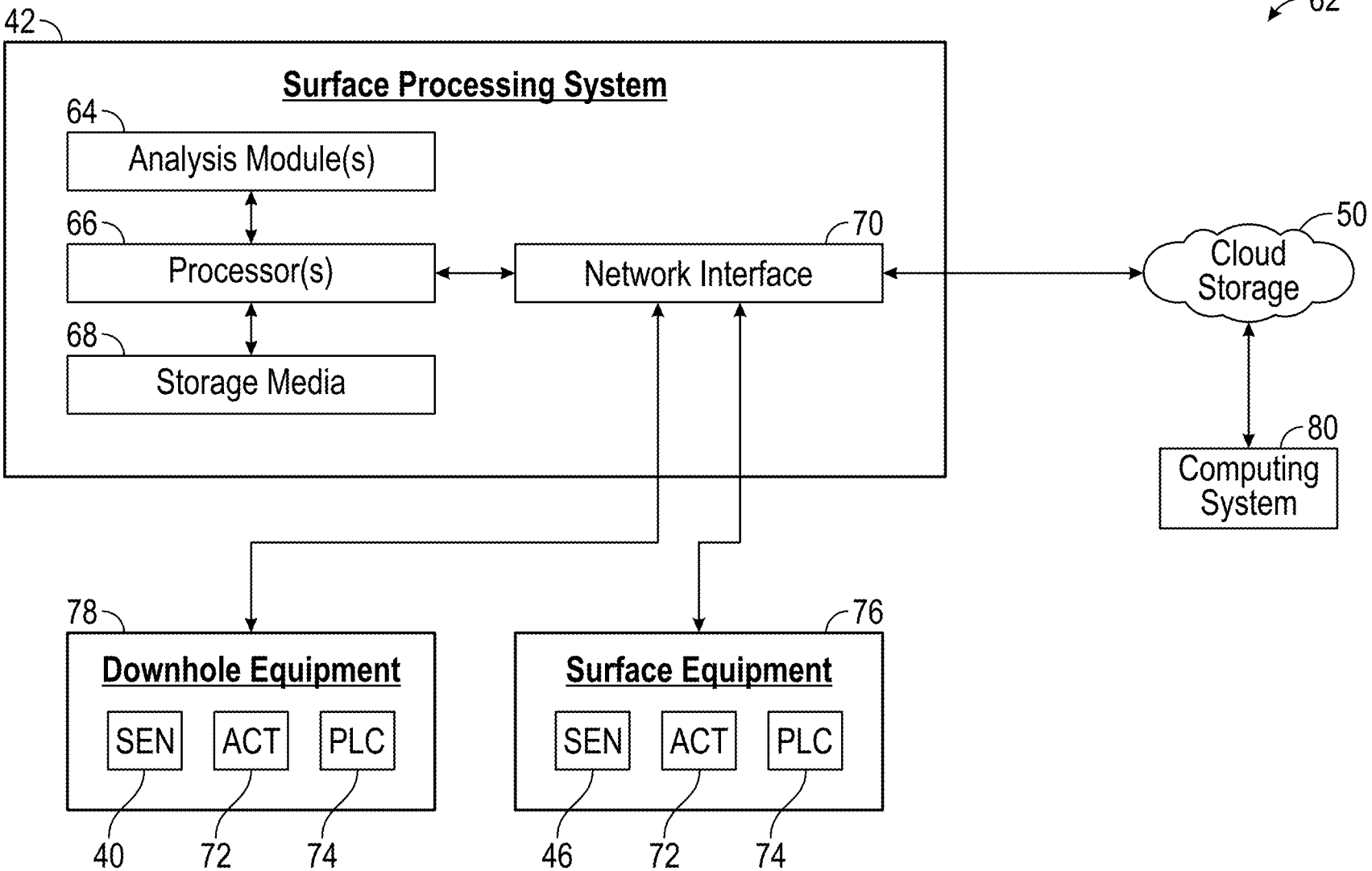
FIG. 2 illustrates a well control system including a surface processing system to control the oil and gas well system of FIG. 1, in accordance with embodiments of the present disclosure.

FIG. 2 illustrates a well control system 62 that may include the surface processing system 42 to control the oil and gas well system 10 described herein. In certain embodiments, the surface processing system 42 may include one or more analysis modules 64 (e.g., a program of computer-executable instructions and associated data) that may be configured to perform various functions of the embodiments described herein. In certain embodiments, to perform these various functions, the one or more analysis modules 64 may execute on one or more processors 66 of the surface processing system 42, which may be connected to one or more storage media 68 of the surface processing system 42. Indeed, in certain embodiments, the one or more analysis modules 64 may be stored in the one or more storage media 68.

In certain embodiments, the computer-executable instructions of the one or more analysis modules 64, when executed by the one or more processors 66, may cause the one or more processors 66 to generate one or more models described in greater detail herein. Such models may be used by the surface processing system 42 to predict values of operational parameters that may or may not be measured (e.g., using gauges, sensors) during well operations.

In certain embodiments, the one or more processors 66 may include a microprocessor, a microcontroller, a processor module or subsystem, a programmable integrated circuit, a programmable gate array, a digital signal processor (DSP), or another control or computing device. In certain embodiments, the one or more processors 66 may include machine learning and/or artificial intelligence (AI) based processors. In certain embodiments, the one or more storage media 68 may be implemented as one or more non-transitory computer-readable or machine-readable storage media. In certain embodiments, the one or more storage media 68 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 64 may be provided on one computer-readable or machine-readable storage medium of the storage media 68, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 68 may be located either in the machine running the machine-readable instructions, or may be located at a remote site from which machine-readable instructions may be downloaded over a network for execution.

In certain embodiments, the processor(s) 66 may be connected to a network interface 70 of the surface processing system 42 to allow the surface processing system 42 to communicate with the multiple downhole sensors 40 and surface sensors 46 described herein, as well as communicate with the actuators 72 and/or PLCs 74 of the surface equipment 76 (e.g., the coiled tubing unit 52, the pump unit 56, the flowback equipment 58, and so forth) and of the downhole equipment 78 (e.g., the BHA 26, the downhole motor 28, the drill bit 30, the downhole well tool 36, and so forth) for the purpose of controlling operation of the oil and gas well system 10, as described in greater detail herein. In certain embodiments, the network interface 70 may also facilitate the surface processing system 42 to communicate data to the cloud storage 50 (or other wired and/or wireless communication network) to, for example, archive the data or to enable external computing systems 80 to access the data and/or to remotely interact with the surface processing system 42.

It should be appreciated that the well control system 62 illustrated in FIG. 2 is only one example of a well control system, and that the well control system 62 may have more or fewer components than shown, may combine additional components not depicted in the embodiment of FIG. 2, and/or the well control system 62 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 62 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments of the present disclosure facilitate the operation of well-related tools. For example, a variety of data (e.g., downhole data and surface data) may be collected to enable optimization of operations of well-related tools such as the downhole well tool 36 illustrated in FIG. 1 by the surface processing system 42 illustrated in FIG. 2 (or other suitable processing systems). In certain embodiments, the data may be provided as advisory data by the surface processing system 42 (or other suitable processing systems). However, in other embodiments, the data may be used to facilitate automation of downhole processes and/or surface processes (i.e., the processes may be automated without human intervention), as described in greater detail herein, by the surface processing system 42 (or other suitable processing system). The embodiments described herein may enhance downhole operations by improving the efficiency and utilization of data to enable performance optimization and improved resource controls.

As described in greater detail herein, the embodiments of the present disclosure also enable a remote field user to configure and/or retrieve data from a battery powered BHA 26 by providing a wireless access point 60 within the BHA 26. Doing so enables the leveraging of edge processing power to analyze data relating to operation of the BHA 26. One of the challenges of utilizing BHAs 26 is obtaining data needed from jobs to improve services. Currently, field users are required to configure components of the BHAs 26 to obtain the correct data and upload configuration data. Wireless remote access enables the configuration of the components of the BHAs 26 for a specific study to obtain data spanning several different jobs. In certain situations, the minimum requirements for the components of the BHAs 26 may be obtained from a client. If there is remaining memory, it may then be configured to obtain additional data to help develop a model of different types of coiled tubing jobs in a controlled manner to obtain data that fills in gaps in the operating envelopes. It also lays the framework to be able to intervene and set up different types of data between sequential runs within different wellbores 14 to either address issues or configuration inefficiencies. Currently, these adaptations would not be possible if the data is not reviewed until after a job is complete.

It is common in some operations that the BHA 26 may be rigged up, but that the BHA 26 is not run into a wellbore 14 for several hours or even days. During such intervals where the BHA 26 is not being run into a wellbore 14, the BHA 26 may be disposed in a location at a field site 82 (e.g., the surface 24 of a oil and gas well system 10) where the BHA 26 is not easily physically accessible by a field user 84, for example, when the BHA 26 is currently stored at an elevated location on a rack 86 (or other structure, such as a manlift). The embodiments described herein enable the field user 84 to turn components of the BHA 26 on and off remotely (e.g., when the BHA 26 is not easily accessible, after rig up of the BHA 26, and so forth) to minimize battery usage of the BHA 26 and verify prognostics health status of the components of the BHA 26 before running the BHA 26 into a wellbore 14. For example, during long periods of inactivity, a burst mode may be configured for components of the BHA 26, so that they may wake up and send updated prognostic data at set intervals to ensure that the BHA 26 is prepared for a next job. The embodiments described herein also enable the battery powered BHA 26 to transmit and communicate data with various downhole well tools 36 of the BHA 26. This eliminates the need for a wired field joint between the battery powered BHA 26 and the other BHA products. This enables different tool families to be utilized together without the need for custom joints, adding to the modularity and reuse of tools.

Figure 3:
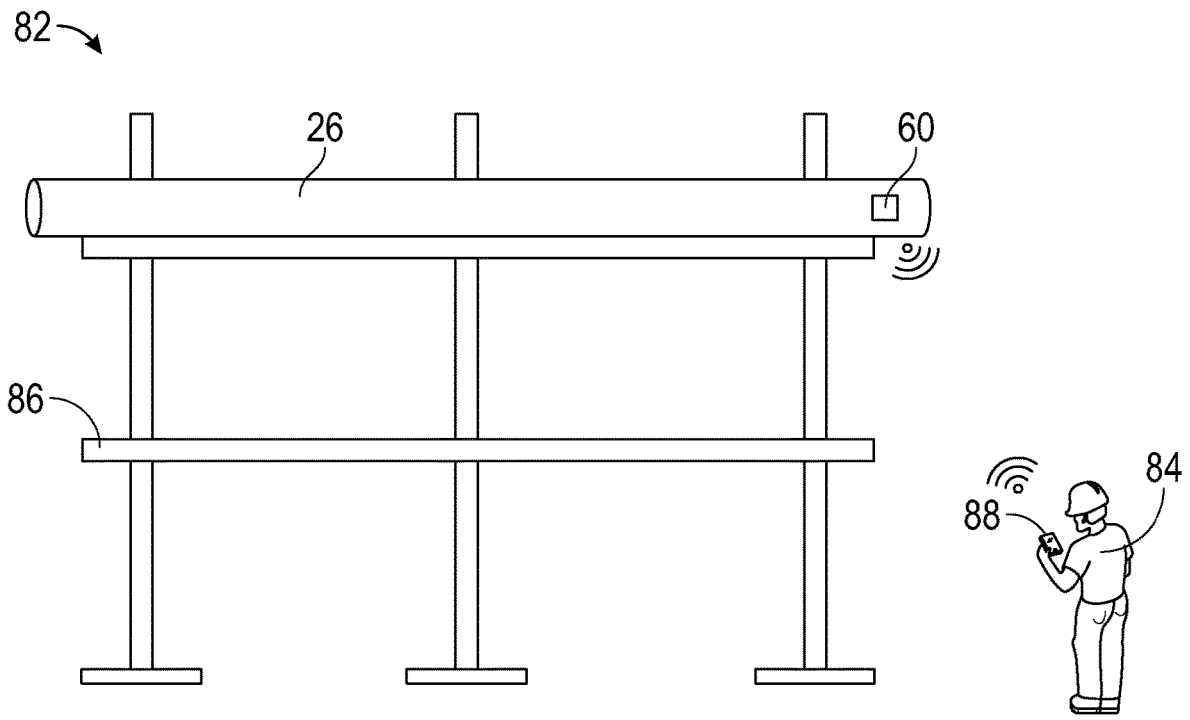
FIG. 3 illustrates a wirelessly-configurable battery-powered BHA disposed at a location not easily accessible by a field user, in accordance with embodiments of the present disclosure.
Figure 4:
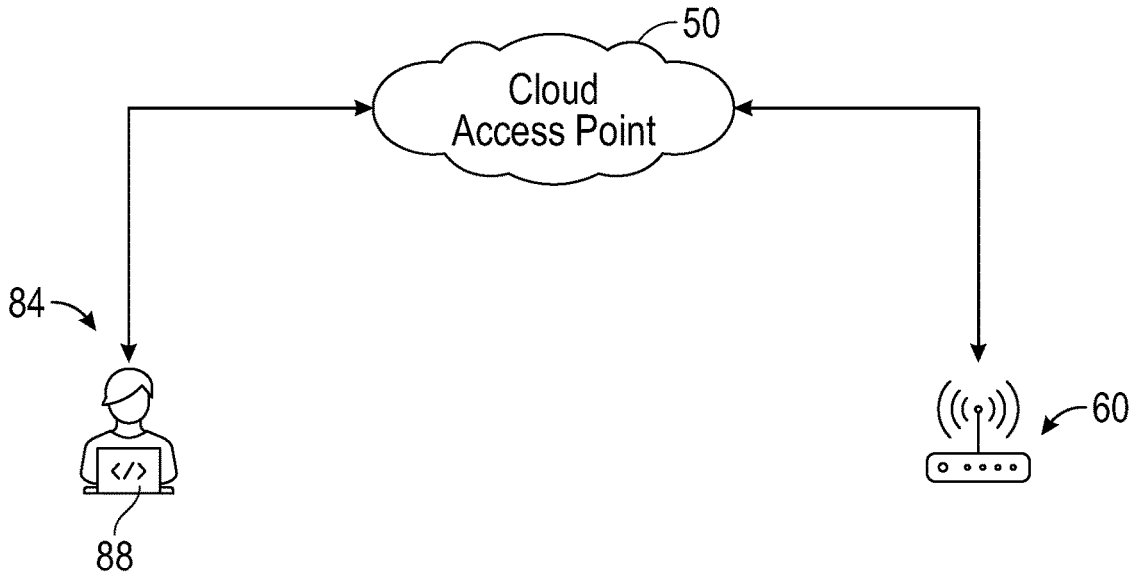
FIG. 4 illustrates how a field user may remotely access a wireless access point of a wirelessly-configurable battery-powered BHA via a cloud access point, in accordance with embodiments of the present disclosure.

As illustrated in FIG. 3, the field user 84 may wirelessly access the components of the BHA 26 using a user computing device 88 configured to wirelessly communicate with a wireless access point 60 of the BHA 26, as described in greater detail herein. In general, any wireless communication protocol may be used to facilitate the wireless communication between the user computing device 88 and the wireless access point 60 of the BHA 26. For example, in certain embodiments, the wireless communication protocol may use the Wi-Fi standard due to its relative prevalence in laptop computers, tablet computers, mobile phones, and so forth. However, again, any suitable wireless communication protocol may be used to facilitate the wireless communication between the user computing device 88 and the wireless access point 60 of the BHA 26, as described in greater detail herein. In addition, as illustrated in FIG. 4, in certain embodiments, the field user 84 may utilize the user computing device 88 to wirelessly access the wireless access point 60 of the BHA 26 via a cloud access point 50.

Figure 5:
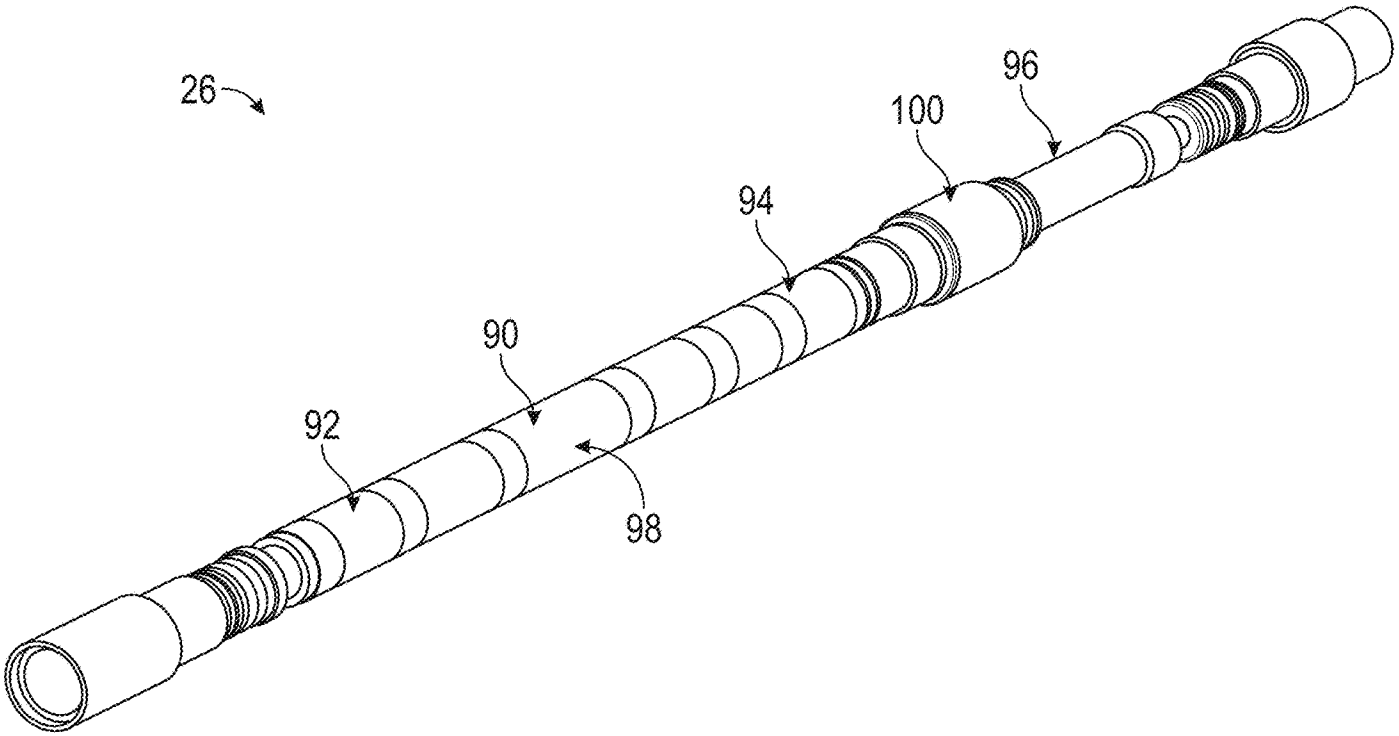
FIG. 5 illustrates an example wirelessly-configurable battery-powered BHA, in accordance with embodiments of the present disclosure.

FIG. 5 illustrates an example wirelessly-configurable battery-powered BHA 26, as described in greater detail herein. As illustrated, in certain embodiments, the BHA 26 may include a wireless access module 90 that includes the wireless access point 60, which as described herein enables a field user 84 to wirelessly configure various components of the BHA 26 including, but not limited to, a three-axis accelerometer 92, one or more pressure gauges 94, and a load cell chassis 96. In addition, in certain embodiments, the BHA 26 may include one or more batteries 98 configured to provide local power for operation of the BHA 26 in situations where power is not available to the BHA 26 from the surface 24, for example, via a telemetric control line 44. In addition, in certain embodiments, the BHA 26 may include a communication port 100 that enables communication between the surface processing system 42 and the BHA 26 during operation of the BHA 26 when disposed downhole within a wellbore 14.

During operation, the various components of the BHA 26 may enable the collection of data relating to wellbore pressures and temperatures, loads (e.g., tension and compression loads), torques, accelerations, and so forth, being experienced by the BHA 26 during operation. In certain embodiments, the wireless access module 90 may be configured to acquire the data collected by the components of the BHA 26 at a particular sample rate. For example, the sample rate may be between about 10 Hz to about 2,000 Hz (e.g., allowing analysis of the data up to about 1,024 Hz). Additionally, or alternatively, in certain embodiments, up to approximately 60 hours of data may be stored locally within the BHA 26 by the wireless access module 90. In addition, in certain embodiments, the wireless access module 90 may be configured to function at up to 350° F. It will be appreciated that these sampling rates, storage hours, and operational temperatures are merely exemplary, and are not intended to be limiting. Indeed, in other embodiments, different sampling rates, storage hours, and operational temperatures may be possible.

In certain embodiments, the wireless access module 90 facilitates field users 84 to remotely configure myriad different operating settings and/or procedures (e.g., modes of operation, workflows to be followed during operation, and so forth) of various components of the BHA 26. For example, in certain embodiments, the wireless access module 90 also facilitates field users 84 to send command signals to remotely configure (e.g., assign) specific communication channels and/or communication protocols of the components of the BHA 26 that are used to acquire specific types of data, for example, when the BHA 26 is located at the surface 24 of the oil and gas well system 10 (e.g., before the BHA 26 is deployed within a wellbore 14). As a further non-limiting example, in certain embodiments, the wireless access module 90 also facilitates field users 84 to send command signals to remotely set timing triggers of the various components of the BHA 26 to define when the various components wake up (e.g., from low-power standby modes) at certain times to collect certain types of data. In addition, in certain embodiments, the wireless access module 90 may facilitate field users 84 to send command signals to download data stored in the wireless access module 90 once the BHA 26 is retrieved at the surface 24 of the oil and gas well system 10 (e.g., after completion of a downhole job).

In addition, in certain embodiments, the wireless access module 90 may facilitate field users 84 to send command signals to cause mechanical features of the various components of the BHA 26 to be physically manipulated (e.g., by changing positions, orientations, and so forth, of the mechanical features) to, for example, enable different operating modes of the components. For example, in certain embodiments, the command signals may be used to cause certain actuators associated with the components of the BHA 26 to physically manipulate valve positions, flow line routings, flow line restrictions, and so forth, of the components in response to the command signals.

Regardless of the types of operating settings and/or procedures of the various components of the BHA 26 that may be adjusted in response to the command signals wirelessly received by the wireless access module 90, the wireless access module 90 may be configured to confirm that the adjustments to the operating settings and/or procedures have been implemented and, in response to the confirmations, may transmit confirmation signals back to the user computing device 88 that wirelessly sent the command signals to the wireless access module 90. For example, in certain embodiments, in response to confirming that requested adjustments to operating settings and/or procedures of various components of the BHA 26 have been implemented, the wireless access module 90 may transmit a confirmation signal to the user computing device 88 that requested the adjustment to automatically launch an application on the user computing device 88 to provide a visual and/or audible notification that the requested adjustments have been implemented.

Figure 6:
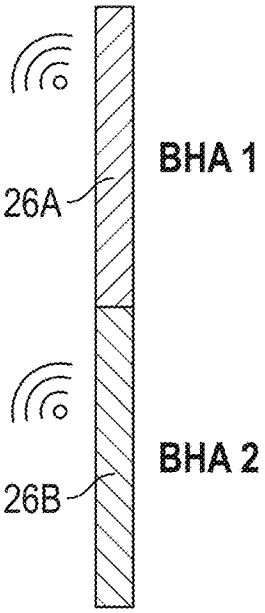
FIG. 6 illustrates two wirelessly-configurable battery-powered BHAs communicating with each other, in accordance with embodiments of the present disclosure.

FIG. 6 illustrates another use case for the wireless access modules 90 of the BHAs 26 described herein. Specifically, the wireless access modules 90 of the BHAs 26 enable multiple BHAs 26 deployed via a single coiled tubing string 12 to communicate with each other while they are deployed within a wellbore 14, thereby enabling the multiple BHAs 26 to alter their operating parameters based at least in part on operating conditions being experienced by the other BHA(s) 26. In particular, FIG. 6 illustrates a first BHA 26A communicating with a second BHA 26B. However, it will be appreciated that more than two BHAs 26 may be configured to communicate with each other when deployed via a single coiled tubing string 12, in other embodiments.

In yet another use case for the wireless access modules 90 of the BHAs 26, in certain embodiments, a particular BHA 26 may include two or more wireless access modules 90, and the plurality of wireless access modules 90 may communicate with each other while the BHA 26 is deployed within a wellbore 14, thereby enabling different portions of the BHA 26 to communicate with each other. For example, in certain situations, the wireless access modules 90 may be located a relatively large distance from each other along the BHA 26, or there may be physical features (e.g., tool components disposed between the wireless access modules 90 along the BHA 26) that impede direct communication between the wireless access modules 90. Having multiple wireless access modules 90 in the single BHA 26 may enable wireless communication throughout the BHA 26 that would otherwise not be possible.

Figure 7:
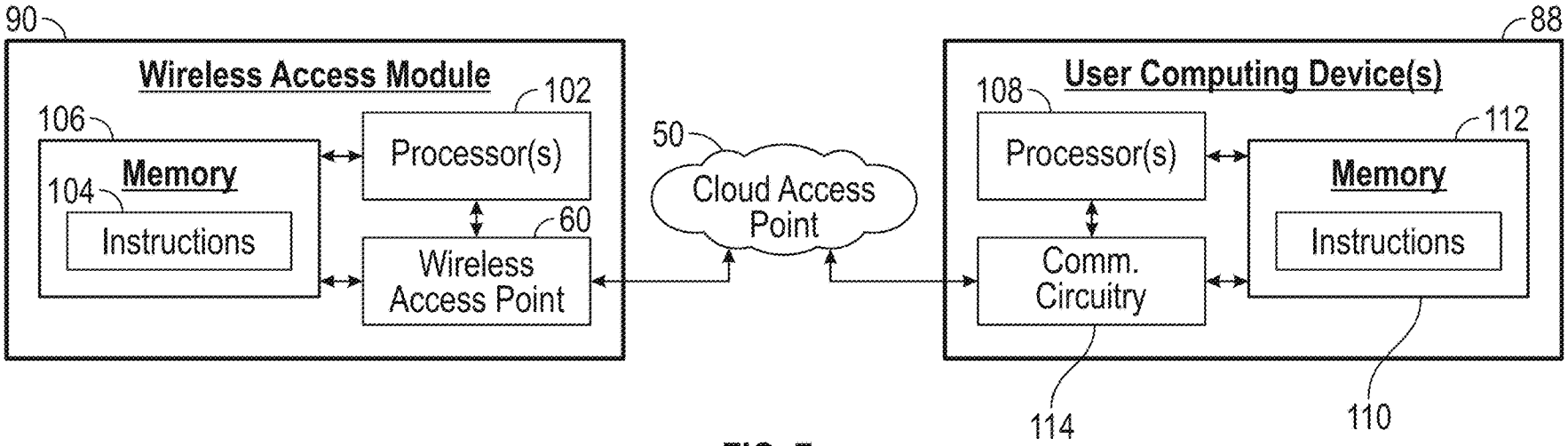
FIG. 7 is a schematic diagram of a wireless access module of a wirelessly-configurable battery-powered BHA and user computing device(s), in accordance with embodiments of the present disclosure.

FIG. 7 is a schematic diagram of a wireless access module 90 of a BHA 26 and user computing device(s) 88. As illustrated in FIG. 7, the wireless access module 90 and the user computing device(s) 88 include various components that enable field users 84 to wirelessly configure various components of the associated BHA 26 using the user computing device(s) 88, as described in greater detail herein. For example, in certain embodiments, the wireless access module 90 may include at least one processor 102 configured to execute instructions 104 stored in at least one memory medium 106 of the wireless access module 90, wherein the instructions 104, when executed by the at least one processor 102, enable the wireless access module 90 to perform the functions described in greater detail herein. In addition, as also illustrated in FIG. 7, in certain embodiments, the wireless access module 90 includes the wireless access point 60, which is configured to communicate with user computing devices 88, wireless access points 60 of other wireless access modules 90 of other BHAs 26, and so forth, as described in greater detail herein. As such, it will be appreciated that the wireless access module 90 may be implemented as a collection of hardware (e.g., the at least one processor 102, the at least one memory medium 106, and the wireless access point 60, among other hardware components) and software (e.g., the instructions 104, as well as other software) that enable field users 84 to wirelessly configure various components of an associated BHA 26 using a user computing device 88, as described in greater detail herein.

As also illustrated in FIG. 7, in certain embodiments, the user computing device(s) 88 may each include at least one processor 108 configured to execute instructions 110 stored in at least one memory medium 112 of the respective user computing device 88, wherein the instructions 110, when executed by the at least one processor 108, enable the user computing device 88 to perform the functions described in greater detail herein. In addition, as also illustrated in FIG. 7, in certain embodiments, the user computing device(s) 88 may each include communication circuitry 114 configured to wirelessly communicate with the wireless access points 60 of wireless access modules 90 of various BHAs 26 to, for example, wirelessly configure various components of the BHAs 26, as described in greater detail herein.

Figure 8:
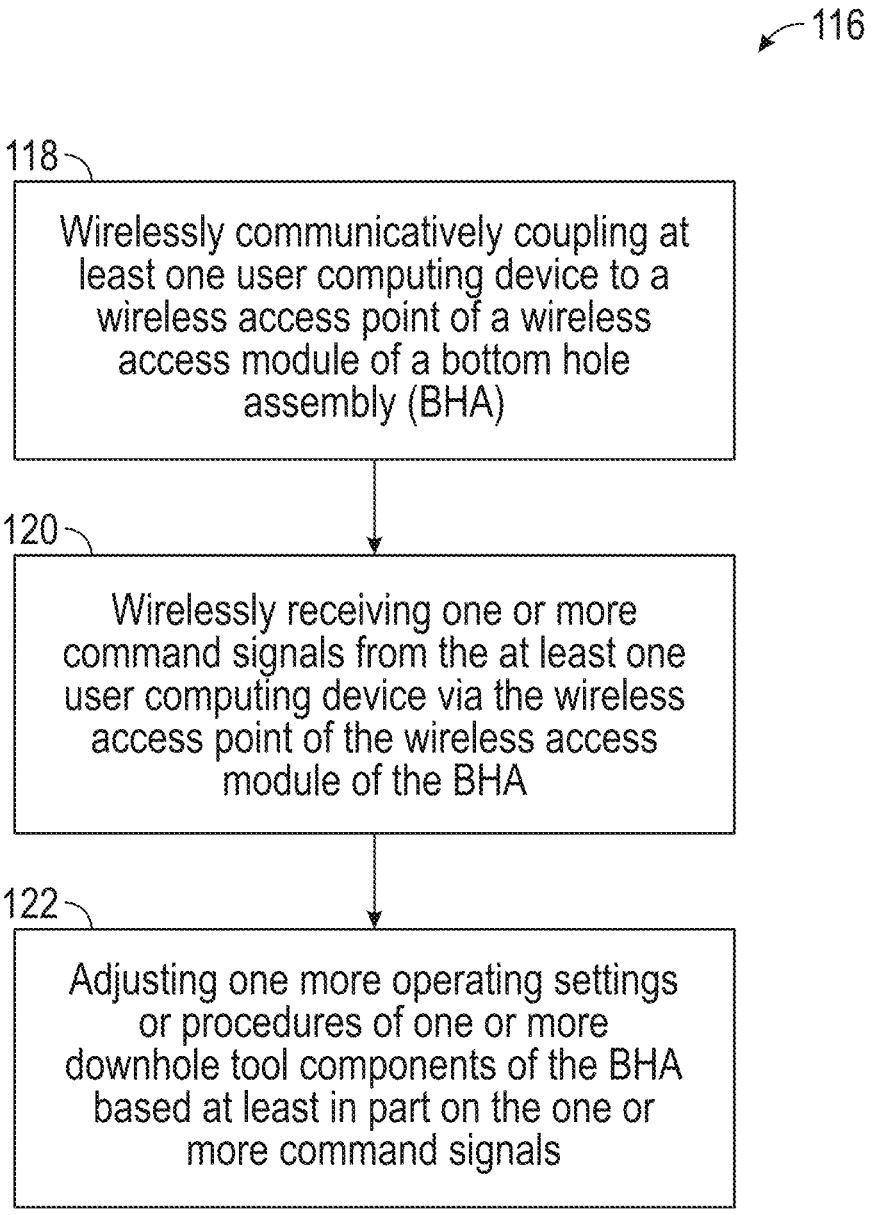
FIG. 8 is a flow diagram of a method for wirelessly configuring components of a wirelessly-configurable battery-powered BHA, in accordance with embodiments of the present disclosure.

FIG. 8 is a flow diagram of a method 116 for wirelessly configuring components of BHA 26, as described in greater detail herein. In certain embodiments, the method 116 may include wirelessly communicatively coupling at least one user computing device 88 to a wireless access point 60 of a wireless access module 90 of a BHA 26 configured to be utilized to perform one or more coiled tubing well operations (step 118). In addition, in certain embodiments, the method 116 may include wirelessly receiving one or more command signals from the at least one user computing device 88 via the wireless access point 60 of the wireless access module 90 of the BHA (step 120). In addition, in certain embodiments, the method 116 may include adjusting one or more operating settings or procedures of one or more downhole tool components (e.g., the three-axis accelerometer 92, pressure gauges 94, load cell chassis 96, batteries 98, communication port 100, and so forth) of the BHA 26 based at least in part on the one or more command signals (step 122). In addition, in certain embodiments, the method 116 may include collecting, via the wireless access point 60 of the wireless access module 90 of the BHA 26, data relating to one or more coiled tubing well operations performed by the one or more downhole tool components of the BHA 26; and storing the data in one or more memory media 106 of the wireless access module 90 of the BHA 26. In addition, in certain embodiments, the method 116 may include wirelessly receiving, via the wireless access point 60 of the wireless access module 90 of the BHA 26, a request from the at least one user computing device 88 to download the data stored in the one or more memory media 106 of the wireless access module 90 of the BHA 26; and wirelessly transmitting, via the wireless access point 60 of the wireless access module 90 of the BHA 26, the data to the at least one user computing device 88. In addition, in certain embodiments, the method 116 may include wirelessly communicatively coupling the wireless access point 60 of the wireless access module 90 of the BHA 26A to a second wireless access point 60 of a second wireless access module 90 of a second BHA 26B; and wirelessly transmitting communications between the wireless access point 60 of the wireless access module 90 of the BHA 26A and the second wireless access point 60 of the second wireless access module 90 of the second BHA 26B during performance of the one or more coiled tubing well operations performed by the one or more downhole tool components of the BHA 26A.

In certain embodiments, adjusting the one or more operating settings or procedures of one or more downhole tool components of the BHA 26 may include assigning wireless communication channels and/or communication protocols utilized by the one or more downhole tool components of the BHA 26 to wirelessly communicate data relating to one or more coiled tubing well operations performed by the one or more downhole tool components of the BHA 26 to the wireless access point 60 of the wireless access module 90 of the BHA 26. In addition, in certain embodiments, adjusting the one or more operating settings or procedures of one or more downhole tool components of the BHA 26 may include setting timing triggers that define when the one or more downhole tool components of the BHA 26 wake from low-power standby modes to collect data relating to the one or more coiled tubing well operations performed by the one or more downhole tool components of the BHA 26. In addition, in certain embodiments, adjusting the one or more operating settings or procedures of one or more downhole tool components of the BHA 26 may include causing mechanical features of the one or more downhole tool components of the BHA 26 to be physically manipulated.

In addition, in certain embodiments, the method 116 may include providing confirmation of adjustment of the one or more operating settings or procedures to the at least one user computing device 88. In addition, in certain embodiments, the method 116 may include wirelessly communicatively coupling the at least one user computing device 88 to the wireless access point 60 of the wireless access module 90 of the BHA 26 via a cloud access point 50.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A method, comprising:

wirelessly communicatively coupling, via at least one user computing device, to a first wireless access point of a first wireless access module of a first bottom hole assembly (BHA) configured to be utilized to perform a first downhole operation, wherein the first wireless access point is configured to communicatively couple to a second wireless access point of a second wireless access module of a second BHA configured to be utilized to perform a second downhole operation;

wirelessly receiving, via the at least one user computing device, one or more communications from the second wireless access point via the first wireless access point;

adjusting, via the at least one user computing device, one or more operating settings or procedures of one or more downhole tool components of the second BHA based at least in part on the one or more communications, wherein the one or more downhole tool components comprise one or more hardware tools that are part of the second BHA; and adjusting one or more additional operating settings or procedures of one or more additional downhole tool components of the first BHA based at least in part on the one or more communications, wherein adjusting the one or more additional operating settings or procedures comprises:

configuring the one or more additional downhole tool components of the first BHA to:

obtain a first set of data associated with a first performance of the first downhole operation; and obtain a second set of data associated with a second performance of the second downhole operation from the second wireless access point, wherein the second set of data is different from the first set of data.

2. The method of claim 1, comprising:

receiving, via the at least one user computing device and from the second wireless access point of the second wireless access module of the second BHA, the second set of data relating to the-second downhole operation performed by the one or more downhole tool components of the second BHA; and storing the second set of data in one or more memory media of the at least one user computing device.

3. The method of claim 2, comprising:

wirelessly sending, via the at least one user computing device, a request to download the second set of data associated with the second downhole operation to the second wireless access point; and wirelessly receiving, via the at least one user computing device, the second set of data from the second wireless access point.

4. The method of claim 1, wherein adjusting the one or more operating settings or procedures of the one or more downhole tool components of the second BHA comprises assigning one or more wireless communication channels and/or one or more communication protocols utilized by the one or more downhole tool components of the second BHA to wirelessly communicate the second set of data associated with the second downhole operation performed by the one or more downhole tool components of the second BHA to the first wireless access point.

5. The method of claim 1, wherein adjusting the one or more operating settings or procedures of the one or more downhole tool components of the second BHA comprises setting one or more timing triggers that define when the one or more downhole tool components of the second BHA wake from one or more low-power standby modes to collect the second set of data associated with the second downhole operation performed by the one or more downhole tool components of the second BHA.

6. The method of claim 1, wherein adjusting the one or more operating settings or procedures of the one or more downhole tool components of the second BHA comprises causing one or more mechanical features of the one or more downhole tool components of the second BHA to be physically manipulated.

7. The method of claim 1, comprising wirelessly communicatively coupling, via the at least one user computing device, to the first wireless access point via a cloud access point.

8. The method of claim 1, wherein adjusting the one or more operating settings or procedures comprises adjusting, via an actuator corresponding to the one or more downhole tool components of the second BHA, a valve position of the second BHA based at least in part on the one or more communications.

9. The method of claim 1, wherein the first wireless access point is configured to wirelessly communicatively couple to a third wireless access point of a third wireless access module, wherein the third wireless access module is part of the first BHA, and wherein the one or more communications are received from the first wireless access point of the first wireless access module of the first BHA via the third wireless access point.

10. A system comprising:

one or more downhole tool components configured to be used by a first bottom hole assembly (BHA) to perform one or more downhole operations, wherein the one or more downhole tool components comprise one or more hardware tools that are part of the first BHA; and a first wireless access module comprising:

a first wireless access point comprising first communication circuitry configured to wirelessly communicatively couple to;

at least one user computing device external to the first BHA; and a second wireless access point of a second wireless access module of a second BHA, wherein the second wireless access point comprises second communication circuitry configured to wirelessly communicatively couple to the first wireless access point;

one or more memory media configured to store:

instructions for operating the first wireless access module; and data collected from the one or more downhole tool components during performance of the one or more downhole operations; and one or more processors configured to execute the instructions stored in the one or more memory media, wherein the instructions cause the one or more processors to perform operations comprising:

receiving, via the first wireless access point, one or more communications from the second wireless access point; and adjusting, via the one or more processors, one or more operating settings of the one or more downhole tool components of the first BHA based at least in part on the one or more communications; and adjusting one or more additional operating settings or procedures of one or more additional downhole tool components of the first BHA based at least in part on the one or more communications, wherein adjusting the one or more additional operating settings or procedures comprises:

configuring the one or more additional downhole tool components of the first BHA to:

obtain a first set of data associated with a first performance of a first downhole operation of the one or more downhole operations; and obtain a second set of data associated with a second performance of a second downhole operation of the one or more downhole operations from the second wireless access point, wherein the second set of data is different from the first set of data.

11. The system of claim 10, wherein the instructions, when executed by the one or more processors, cause the one or more processors to perform the operations comprising:

wirelessly receiving one or more command signals from the at least one user computing device via the first wireless access point; and adjusting the one or more operating settings of the one or more downhole tool components based at least in part on the one or more command signals.

12. The system of claim 10, wherein adjusting the one or more operating settings of the one or more downhole tool components comprises:

assigning one or more wireless communication channels utilized by the one or more downhole tool components to wirelessly communicate the data collected by the one or more downhole tool components to the second wireless access point.

13. The system of claim 10, wherein adjusting the one or more operating settings of the one or more downhole tool components comprises setting one or more timing triggers that define when the one or more downhole tool components wake from one or more low-power standby modes to collect the data.

14. The system of claim 10, wherein adjusting the one or more operating settings of the one or more downhole tool components comprises causing one or more mechanical features of the one or more downhole tool components of the first BHA to be physically manipulated.

15. The system of claim 10, wherein the instructions, when executed by the one or more processors, cause the one or more processors to provide confirmation of adjustment of the one or more operating settings to the at least one user computing device.

16. The system of claim 10, wherein the instructions, when executed by the one or more processors, cause the one or more processors to perform the operations comprising:

collecting, via the first wireless access point, the data collected by the one or more downhole tool components; and storing the data in the one or more memory media.

17. The system of claim 16, wherein the instructions, when executed by the one or more processors, cause the one or more processors to perform the operations comprising:

wirelessly receiving, via the first wireless access point, a request from the at least one user computing device to download the data stored in the one or more memory media; and wirelessly transmitting, via the first wireless access point, the data to the at least one user computing device.

18. The system of claim 10, wherein the instructions, when executed by the one or more processors, cause the one or more processors to perform the operations comprising wirelessly communicatively coupling the first wireless access point to the at least one user computing device via a cloud access point.

19. A first wireless access module configured to be installed within a first bottom hole assembly (BHA) configured to be utilized to perform one or more downhole operations, the first wireless access module comprising:

a first wireless access point comprising a first communication circuitry configured to wirelessly communicatively couple to at least one user computing device external to the first BHA; and an additional second wireless access point of an additional second wireless access module device of an additional second BHA, wherein the additional second wireless access point comprises an additional second communication circuitry configured to wirelessly communicatively couple to the first wireless access point;

one or more memory media configured to store:

instructions for operating the first wireless access module, wherein the first wireless access module comprises a hardware assembly that is part of the first BHA; and data collected from one or more downhole tool components of the first BHA during performance of the one or more downhole operations; and one or more processors configured to execute the instructions stored in the one or more memory media, wherein the instructions, when executed by the one or more processors, cause the one or more processors to perform operations comprising:

receiving, via the first wireless access point, one or more communications from the additional second wireless access point; and adjusting one or more operating settings and procedures of the one or more downhole tool components of the first BHA based at least in part on the one or more communications; and adjusting one or more additional operating settings or procedures of one or more additional downhole tool components of the first BHA based at least in part on the one or more communications, wherein adjusting the one or more additional operating settings or procedures comprises:

configuring the one or more additional downhole tool components of the first BHA to:

obtain a first set of data associated with a first performance of a first downhole operation of the one or more downhole operations; and obtain a second set of data associated with a second performance of a second downhole operation of the one or more downhole operations from the additional second wireless access point, wherein the second set of data is different from the first set of data.

* * * * *